US009242812B2

(12) United States Patent
Geesmeier

(10) Patent No.: US 9,242,812 B2
(45) Date of Patent: Jan. 26, 2016

(54) CASH BOX WITH A BLOCKING ELEMENT FOR CLOSING THE GAP BETWEEN BOTTOM CONTAINER AND RETAINING ELEMENT

(71) Applicant: Wincor Nixdorf International GmbH, Paderborn (DE)

(72) Inventor: Andreas Geesmeier, Bad Wünnenberg (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/619,665

(22) Filed: Feb. 11, 2015

(65) Prior Publication Data

US 2015/0246780 A1 Sep. 3, 2015

(30) Foreign Application Priority Data

Feb. 28, 2014 (EP) ..... 14157334

(51) Int. Cl.

| | |
|---|---|
| ***G07F 19/00*** | (2006.01) |
| ***B65H 1/26*** | (2006.01) |
| ***G07D 11/00*** | (2006.01) |
| ***B65H 5/00*** | (2006.01) |
| ***B65H 7/00*** | (2006.01) |
| ***B65H 9/04*** | (2006.01) |

(52) U.S. Cl.

CPC .. *B65H 1/26* (2013.01); *B65H 5/00* (2013.01); *B65H 7/00* (2013.01); *B65H 9/04* (2013.01); *G07D 11/0009* (2013.01); *G07D 11/0012* (2013.01)

(58) Field of Classification Search

CPC ..... B65H 2301/4219; G07D 11/0027; G07F 19/20; G07F 19/202

USPC ..... 235/379, 380; 902/8, 13

See application file for complete search history.

(56) References Cited

U.S. PATENT DOCUMENTS

| | | | | |
|---|---|---|---|---|
| 6,779,728 | B2 * | 8/2004 | Nomiyama et al. | 235/485 |
| 7,780,073 | B2 * | 8/2010 | Graef et al. | 235/379 |

FOREIGN PATENT DOCUMENTS

| | | | |
|---|---|---|---|
| DE | 28 00 707 | A1 | 8/1979 |
| DE | 10 2009-058519 | A1 | 6/2011 |

* cited by examiner

*Primary Examiner* — Seung Lee

(74) *Attorney, Agent, or Firm* — Harness, Dickey & Pierce, P.L.C.

(57) ABSTRACT

The invention relates to a cash box comprising a receiving area for receiving a value note stack and a bottom unit delimiting the receiving area towards a box bottom. Further, a retaining element is provided which, in a retaining position, retains the notes of value received in the receiving area in said receiving area. Between the retaining element and the bottom unit a gap is formed. The cash box has at least one blocking element which, at least when the closing unit is closed, closes the gap at least so far that no note of value can slip into the gap.

15 Claims, 4 Drawing Sheets

CASH BOX WITH A BLOCKING ELEMENT FOR CLOSING THE GAP BETWEEN BOTTOM CONTAINER AND RETAINING ELEMENT

CROSS-REFERENCE TO RELATED APPLICATIONS

This application claims priority to European patent application EP 14 157 334.5 filed Feb. 28, 2014 which is hereby incorporated by reference in its entirety.

BACKGROUND OF THE INVENTION

The invention relates to a cash box comprising a receiving area for receiving a value note stack. The cash box has an opening for automatically feeding and/or removing notes of value which is closable by a closing unit as well as a bottom unit which delimits the receiving area towards a box bottom and on which the notes of value stand in particular on their edges. In the area of the opening, a retaining element is provided which, in a retaining position, retains the notes of value received in the receiving area in said receiving area and which, in a feeding position, enables a feeding and/or removing of the notes of value through the opening. Between the retaining element and the bottom unit, a gap is formed.

In known cash boxes, the retaining element can be pivoted between the retaining position and the feeding position so that, after the feeding of notes of value through the opening, by moving the retaining element into the retaining position the notes of value received in the receiving area are held therein and cannot slip out of the receiving area. Conditioned by construction, a gap has to be formed between the bottom unit on which the notes of value received in the receiving area stand on their edges and the retaining element since otherwise the deposit and withdrawal of the notes of value through the opening would not be possible. In particular, this gap is necessary to achieve sufficient room to manoeuvre with respect to the retaining element.

In addition to the opening for the automatic feeding and/or removing of notes of value, known cash boxes have another opening which is closable by a cover and through which notes of value can be manually fed and/or removed. During this manual feeding of notes of value it may happen that, in particular when the notes of value have a bad quality, notes of value slip into the gap existing between the retaining element arranged in the retaining position and the bottom unit. In a subsequent automatic feeding or removing of notes of value through the corresponding opening, these notes of value may cause problems.

Such a cash box is, for example, known from document DE 10 2009 058 519 A1.

It is the object of the invention to specify a cash box by means of which a safe, reliable automatic feeding and/or removing of notes of value respectively to and from a receiving area of the cash box is possible.

According to an aspect of the invention, the cash box has at least one blocking element which, at least when the closing unit is closed, closes the gap between the bottom unit and the retaining element so far that no note of value can slip into this gap. Thus, by means of the blocking element it is prevented that notes of value can slip into the gap and thus that problems may arise during the feeding and/or removal of notes of value through the opening. When the closing unit is closed, i.e. when the closing unit closes the opening for the automatic feeding and/or removal of notes of value, the retaining element is in particular arranged in the retaining position so that it retains the notes of value received in the receiving area therein. The blocking element then closes the gap existing between the retaining element arranged in the retaining position and the bottom unit at least in part so that no note of value can slip therein since the dimensions of the cash box are adapted such that almost the entire width of the gap is required so that a note of value can slip into this gap.

The bottom unit in particular comprises several drivable belts on which the notes of value which are received in the receiving area stand on their edges.

The closing unit is in particular designed such that, when it is open, it is received in a gap between the bottom unit and a box bottom. The box bottom is in particular formed by a housing of the cash box.

In a preferred embodiment at least one further blocking element is provided which, at least when the closing unit is closed, closes the gap between the retaining element and the bottom unit at least so far that no note of value can slip into the gap. Alternatively, also more than two blocking elements, for example, three blocking elements can be provided.

The more blocking elements are provided, the safer the slipping of notes of value into the gap is prevented since the still remaining gap becomes smaller. In particular, the distance between the blocking element and the side walls of the cash box is thus reduced so that even in the case of jammed or transversely arranged notes of value these cannot slip into the gap.

Further, it is advantageous when the two blocking elements are identically formed so that only one component type has to be produced, as a result whereof the production costs are reduced. In addition, mix-ups during assembly are prevented.

Further, it is advantageous when the two blocking elements are arranged mirror-symmetrically with respect to the center plane of the cash box so that the gap is uniformly closed.

The following features described for the blocking element can be used analogously—additionally or alternatively—also for further or the further blocking elements.

It is particularly advantageous when a first end of the blocking element is mounted to the closing unit. In a particularly preferred embodiment, both the first end and a second end opposite to the first end are each mounted to the closing unit, preferably in an articulated manner. By articulated mounting it is meant that the ends are each mounted to the closing unit rotatably relative thereto.

By mounting the blocking element to the closing unit it is achieved that the blocking element is moved automatically with the closing unit so that, when the closing unit is opened, the blocking element is moved together therewith out of the area of the opening so that it does not impede a feeding and/or removing of notes of value through the opening.

The first end and/or the second end of the blocking element are mounted to the closing unit in particular via an elastic element, preferably a spring. In this way, it is achieved that the blocking element does not impede the movement of the closing unit, in particular since the closing unit is designed like a roller shutter and comprises several partial areas articulated to one another, the rotation of which relative to each other would be impeded or completely prevented without the elastic element.

The blocking element is in particular movable between a first position in which it enables a feeding of notes of value through the opening into the receiving area and a second position, wherein the blocking element is arranged in the second position such that it closes the gap and would impede a feeding and/or removing of notes of value through the opening. Thus, it is achieved that it safely and reliably closes the gap in the second position and does not affect the function of the cash box in the first position.

The blocking element is in particular mounted to the closing unit such that it is moved between the first and second position when the closing unit is opened and closed. Thus, it is achieved that no own drive unit for moving the blocking element is required but this blocking element is automatically moved when the closing unit is opened and closed. Thus, no further constructive modifications to the cash box are required.

Further, it is advantageous when the closing unit closes the opening in a closed position and does not close the opening in an open position, and when the blocking element is arranged in the first position when the closing unit is arranged in the open position, and is arranged in the second position when the closing unit is arranged in the closed position. Thus, the existing kinematics of the cash box can be used so that the function can be realized cost-efficiently.

Further, it is advantageous when the cash box has a further opening for manually feeding notes of value which is closable by a cover. Through this opening, notes of value can be removed and/or fed manually in a cash center. During this manual feeding and/or removal of notes of value the closing unit is arranged in the closed position and the retaining element is moved into the retaining position. Accordingly, the blocking element is arranged in the second position so that it prevents a slipping of notes of value into the gap between the retaining element and the bottom unit of the cash box.

The blocking element is preferably designed in a bar-shaped manner, in particular in a rod-shaped manner, so that a particularly simple and nevertheless stable form results.

In the open position, the closing unit is received at least in part, preferably completely, in a gap formed between the bottom unit and the box bottom. By mounting the blocking element to the closing unit, the blocking element is likewise moved into the gap so that it does not represent any obstacle when the closing unit is open.

BRIEF DESCRIPTION OF THE DRAWINGS

Further features and advantages of the invention result from the following description which explains the invention in more detail on the basis of embodiments in connection with the enclosed Figures.

DETAILED DESCRIPTION OF THE PREFERRED EMBODIMENTS

Figure 1:
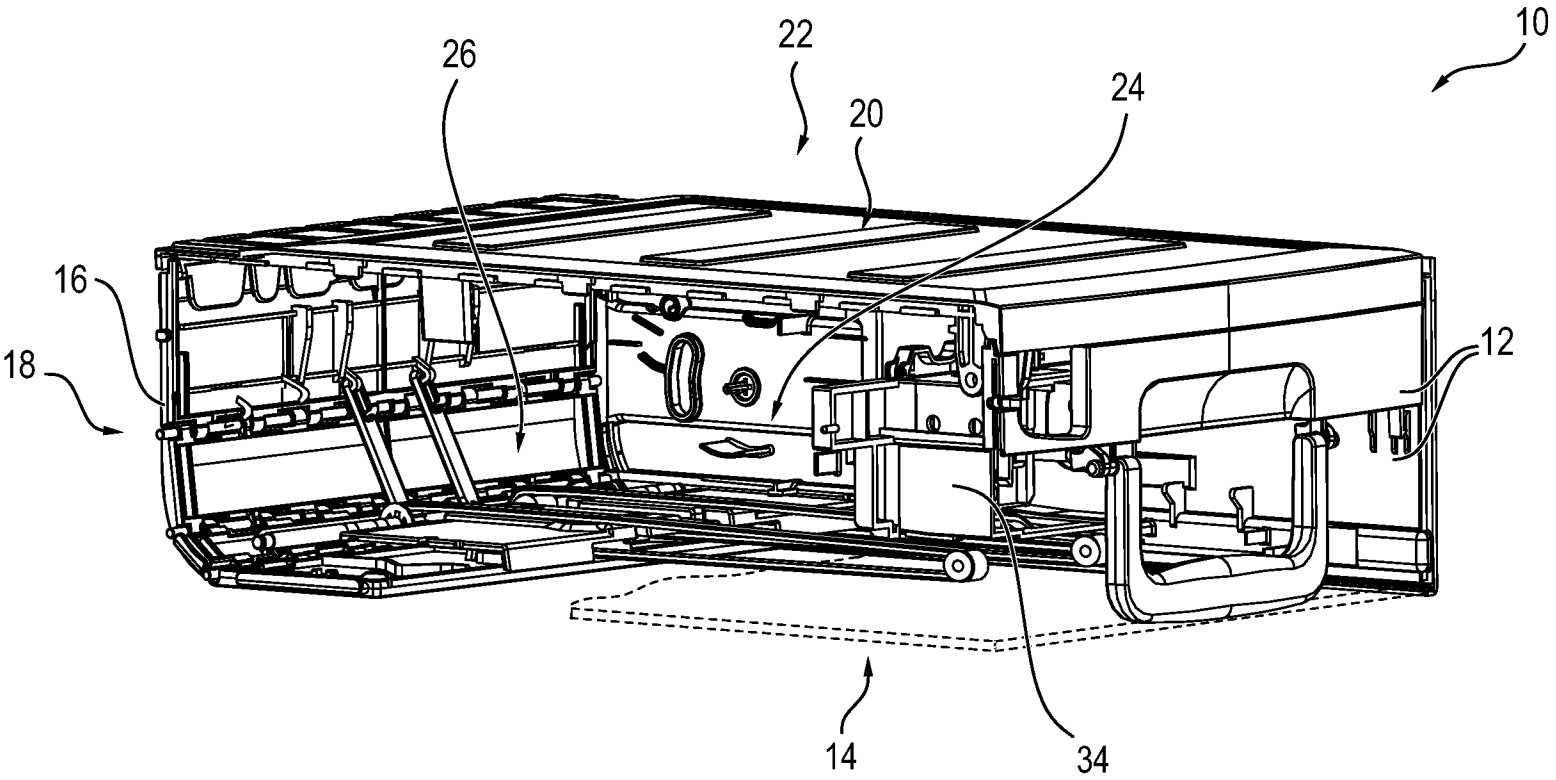
FIG. 1 shows a schematic perspective illustration of a cash box with the housing being partly not illustrated.

In FIG. 1, a schematic perspective illustration of a cash box 10 is shown. The cash box 10 comprises a housing 12 which, inter alia, has a box bottom 14 which, when oriented as planned, forms the underside of the cash box 10.

The cash box 10 has a first opening 18 which is closable by means of a closing unit 16 and serves for the automatic feeding and/or removing of notes of value to and from the cash box 10, respectively. The automatic feeding and/or removing of notes of value in particular takes place by means of separating and stacking modules of a device for handling notes of value, such as an automated teller machine, an automatic cash register system and/or an automatic cash safe.

Further, the cash box 10 has a second opening 22 closable by a cover 20, through which opening notes of value can be manually removed from the receiving area and can be fed into the receiving area 24, respectively.

Towards the box bottom 14, the receiving area 24 is delimited by a bottom unit 26 which has two belts 30, guided over gear wheels 28, the notes of value received in the form of a value note stack being arranged on the belts standing on their edges.

At the end opposite to the first opening 16, the receiving area 24 is delimited by a movably arranged press-on carriage 34 by means of which the notes of value of the received value note stack are always held under a required minimum pressure so that a falling over is prevented. The press-on carriage 34 is moved the further away from the first opening, the more notes of value are received in the receiving area 24.

Figure 2:
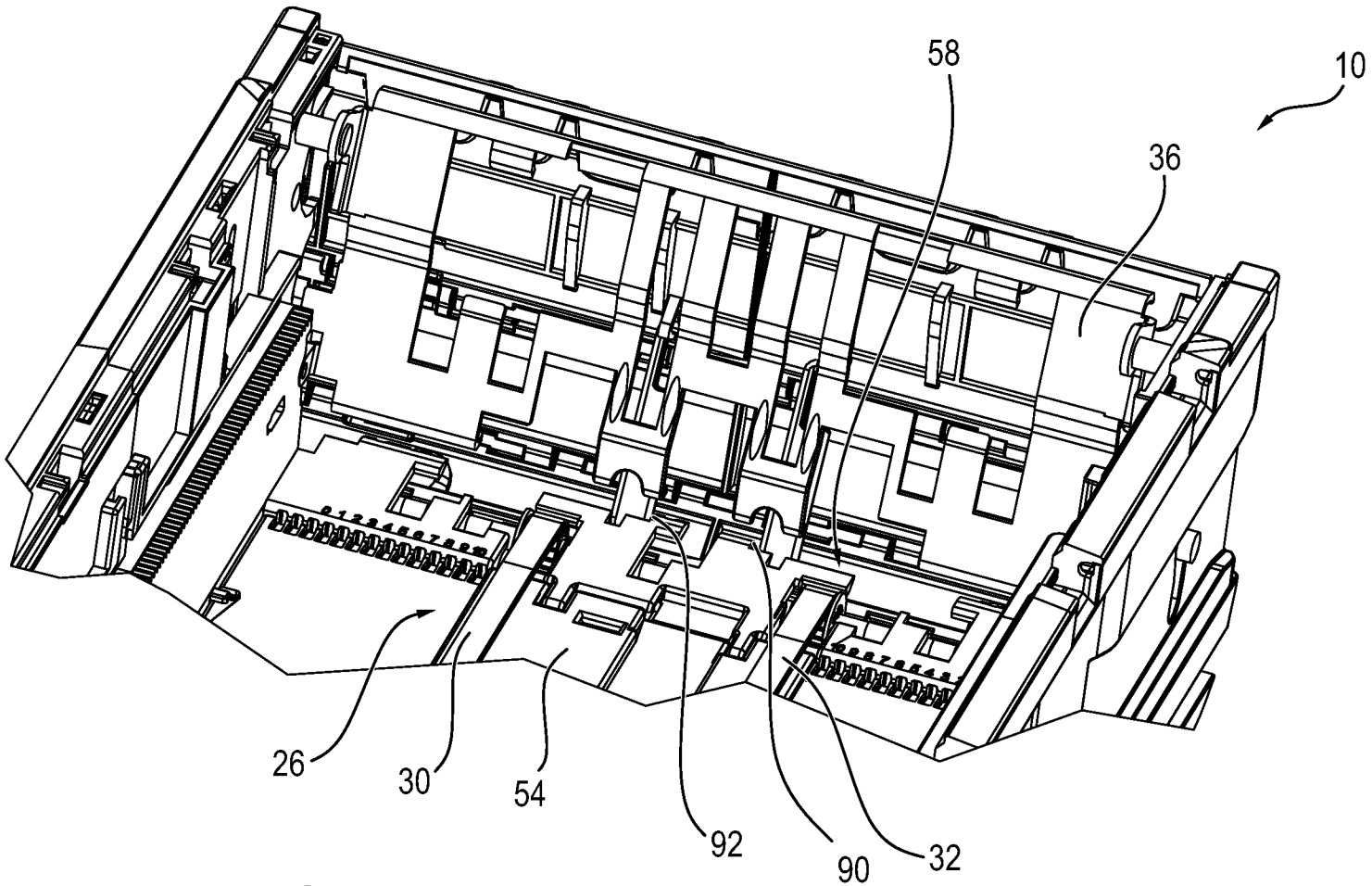
FIG. 2 shows a detail of the cash box according to FIG. 1.
Figure 3:
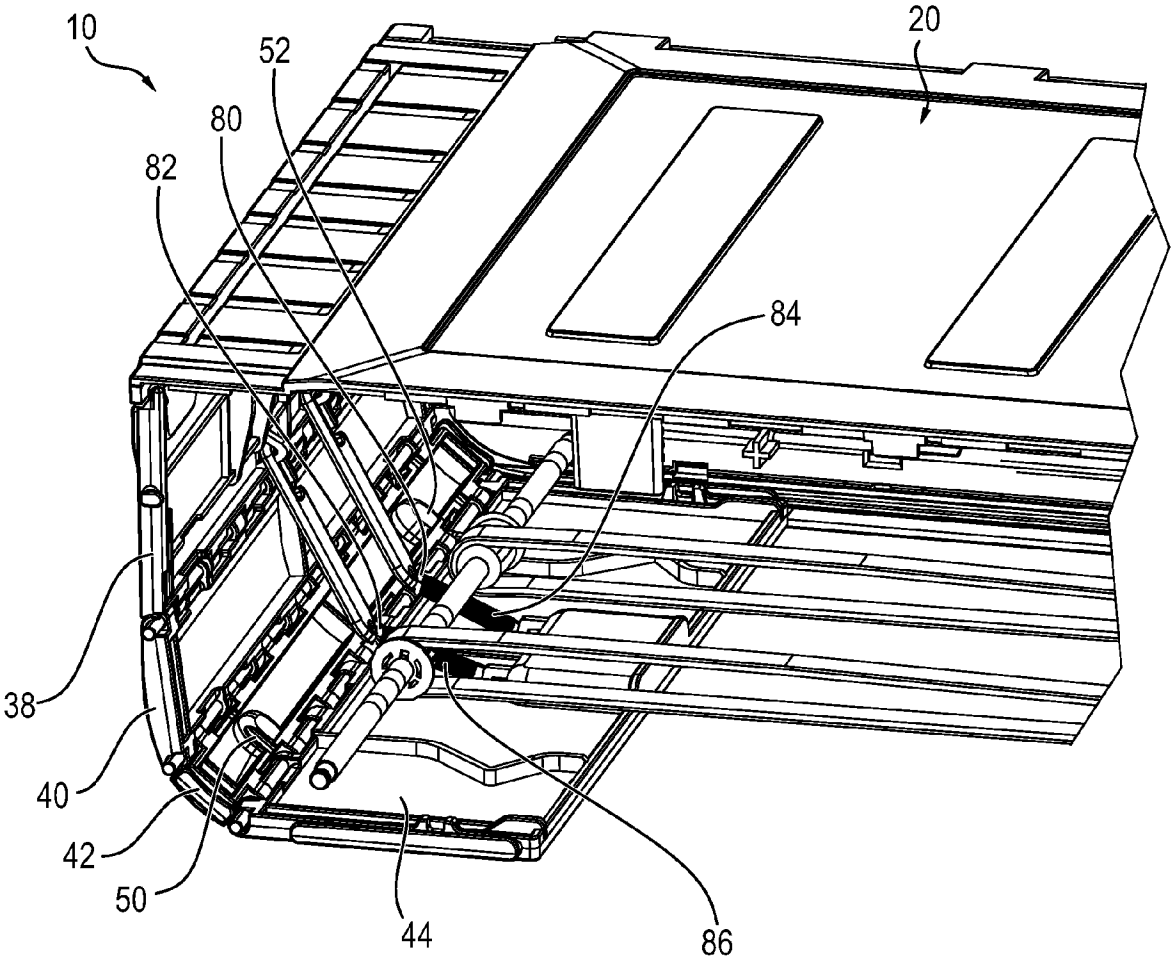
FIG. 3 shows a further detail of the cash box according to FIG. 1.
Figure 4:
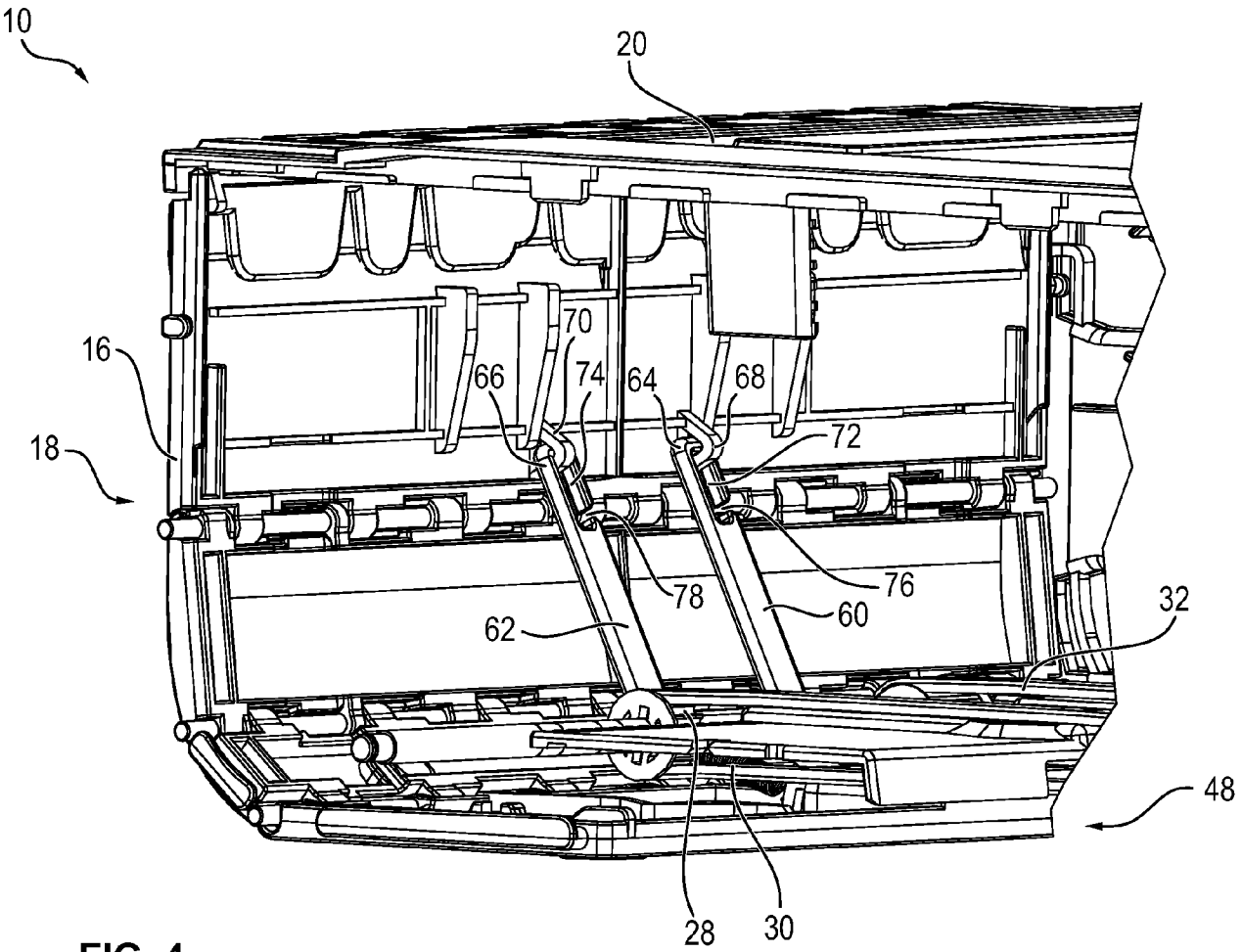
FIG. 4 shows a further detail of the cash box according to FIG. 1.

In FIGS. 2 to 4, each time a schematic perspective illustration of a detail of the cash box 10 according to FIG. 1 is shown, each time the area of the first opening 18 being shown. Here, in the various Figures, different elements of the cash box 10 are not illustrated in order to make the respective other illustrated elements better visible.

In the area of the first opening 18, a retaining element 36 is arranged, which is pivotable between a retaining position illustrated in FIG. 2 and a feeding position. In the retaining position 36, the retaining element is arranged such that it retains the notes of value arranged in the receiving area 24 therein in that it presses against the notes of value arranged at the front side of the value note stack. In the feeding position, on the other hand, the retaining element 36 is arranged such that it enables a feeding and/or removing of notes of value into the receiving area 24 and out of the receiving area 24, respectively.

The retaining element 36 is in particular arranged in the retaining position whenever the closing unit 16 is arranged in a closed position, i.e. is arranged in a position in which the closing unit 16 closes the first opening 18.

If, on the other hand, the closing unit 16 is arranged in an open position so that a feeding and/or removing of notes of value through the first opening 18 takes place, the retaining element 36 is arranged in the feeding position in which it no longer presses against the already received notes of value. Only when the feeding and/or removing of notes of value is terminated and the closing unit 16 is closed again, the retaining element 36, too, is again pivoted into the retaining position.

The closing unit 16 has several partial areas 38 to 44, which are each articulated to one another so that there results some type of roller shutter via which the opening 18 can be closed and which can be moved easily around the lower edge of the cash box in an arc-shaped manner.

Between the bottom unit 26 and the box bottom 14 a gap 48 is formed in which the closing unit 16 is arranged at least in part when it is arranged in the open position. In this way, the closing unit 16 can be received in a space-saving manner.

In the partial area 42, engagement elements 50, 52 are provided with which complementary engagement elements of a device for handling notes of value, e.g. an automatic teller machine, can engage when inserting the cash box 10 so that the closing unit 18 is automatically opened when a cash box 10 is inserted into an automatic teller machine and is automatically closed when the cash box 10 is removed so that an opening and closing of the closing unit 16 without a drive unit, such as a motor, is reliably possible.

As can be seen well in FIG. 2, a gap 58 is formed between the retaining element 36 arranged in the retaining position and the bottom unit 26, in particular a limiting element 50 of the bottom unit 26, which gap is required so that the automatic feeding and/or removing of notes of value is possible.

What is problematic with this gap 54 is that, when manually feeding notes of value through the second opening 24, notes of value may easily slip into this gap, which then during the automatic deposit and withdrawal may result in problems.

To prevent this, two blocking elements 60, 62 are provided which close the gap 58 at least so far that no note of value can slip into it. The two blocking elements 60, 62 are in particular identically formed and arranged mirror-symmetrically with respect to a center plane 64 of the cash box 10.

In an alternative embodiment, also only one blocking element 60, 62 or more than two blocking elements 60, 62, for example three blocking elements 60, 62, may be provided. Further, it is alternatively likewise possible that the blocking elements 60, 62 are not arranged mirror-symmetrically with respect to the center plane 64. Likewise, it may alternatively be possible that the blocking elements 60, 62 are designed differently.

The first ends 64, 66 of the blocking elements 60, 62 are articulated to the closing unit 16 in that they are hooked into receiving elements 68, 70. For this, the blocking elements 60, 62 in particular each have a recess 72, 74 having an opening 76, 78 through which the first ends 64, 66 can be hooked into the receiving elements 68, 70 so that a particularly easy assembly is possible.

The second ends 80, 82 of the blocking elements 60, 62, too, are mounted to the closing unit 16, this mounting being accomplished by springs 84, 86. Alternatively, also other elastic elements can be used.

The first ends 64, 66 and the second ends 80, 82 of the blocking elements 60, 62 are in particular mounted to different partial areas 38 to 44 of the closing unit 16.

When the closing unit 16 is arranged in the closed position shown in FIGS. 2 to 4, the blocking elements 60, 62 are arranged in the second position in which they close the gap 58 at least so far that no note of value can slip into this gap.

When the closing unit 16 is moved from the closed into the open position, then the blocking elements 60, 62 are automatically moved therewith and thus from the second into a first position in which they are no longer arranged within the gap 58 and thus do not impede a feeding and/or removing of notes of value through the now open first opening 18.

By mounting the blocking elements 60, 62 to the closing unit 16, it is achieved that the movement of the blocking elements 60, 62 from the second into the first position or vice versa takes place automatically with the opening and closing of the closing unit 16 so that for this no own actuators, in particular no drive unit, have to be provided but this is automatically possible with the existing mechanism of the cash box 10.

By using elastic elements 84, 86 for mounting the second ends 80, 82 of the blocking elements 60, 62 to the closing unit 16 it is achieved that the blocking elements 60, 62 do not impede the movement of the closing unit 16, in particular the rotation of the individual partial areas 38 to 44 relative to each other.

The blocking elements 60, 62 are preferably received in the gap 48 together with the closing unit 16 when the closing unit 16 is arranged in the open position.

The blocking elements 60, 62 are formed between the ends 64, 66, 80, 82 in particular in a bar-shaped manner so that a particularly simple form results.

On the limiting element 54 of the bottom unit 56, in particular projections 90, 92 are formed over which the blocking elements 60, 62 are laterally guided when moved between the first and the second position so that a safe guided movement takes place.

The invention claimed is:

1. A cash box, comprising a receiving area for receiving a value note stack, an opening for automatically feeding or removing notes of value to and from the receiving area, respectively, which opening is closable by a closing unit, a bottom unit delimiting the receiving area towards a box bottom, and a retaining element which, in a retaining position, retains the notes of value received in the receiving area in said receiving area and which, in a feeding position, enables a feeding or removing of the notes of value through the opening, wherein a gap is formed between the retaining element and the bottom unit, wherein at least one blocking element is provided, which, at least when the closing unit is closed, closes the gap at least so far that no note of value can slip into the gap.

2. The cash box according to claim 1, wherein at least one further blocking element for closing the gap is provided.

3. The cash box according to claim 2, wherein the two blocking elements are identically formed.

4. The cash box according to claim 2, wherein the two blocking elements are arranged mirror-symmetrically to a center plane of the cash box.

5. The cash box according to claim 1, wherein a first end of the blocking element is mounted to the closing unit, in particular in an articulated manner.

6. The cash box according to claim 5, wherein a second end of the blocking element opposite to the first end is likewise mounted to the closing unit, in particular in an articulated manner.

7. The cash box according to claim 6, wherein the first end or the second end of the blocking element is mounted to the closing unit by an elastic element, in particular a spring.

8. The cash box according to claim 6, wherein the closing unit comprises several elements articulated to one another, and that the first and the second end are mounted to different ones of these elements.

9. The cash box according claim 1, wherein the closing unit is designed like a roller shutter.

10. The cash box according to claim 1, wherein the blocking element is movable between a first position in which a feeding of notes of value through the opening to the receiving area is possible, and a second position, and that the blocking element, at least in the second position, closes the gap at least so far that no note of value can slip into the gap.

11. The cash box according claim 10, wherein the blocking element is mounted to the closing unit such that the blockin element is moved between the first and the second position when the closing unit is opened and closed.

12. The cash box according to claim 11, wherein the closing unit closes the opening in a closed position and does not close the opening in an open position, and that the blocking element is arranged in the first position when the closing unit is arranged in the open position and is arranged in the second position when the closing unit is arranged in the closed position.

13. The cash box according to claim 1, wherein the cash box has a further opening for manually feeding notes of value which is closable by a cover.

14. The cash box according to claim 1, wherein the blocking element is bar-shaped.

15. The cash box according to claim 1, wherein in the open position the closing unit is received at least in part, preferably almost completely, in a gap between the bottom unit and the box bottom.

* * * * *